US005346164A

United States Patent [19]

Allen

[11] Patent Number: 5,346,164

[45] Date of Patent: Sep. 13, 1994

[54] KEYBOARD COVER AND WRIST REST

[75] Inventor: Michael Allen, Perkasie, Pa.

[73] Assignee: Fellowes Manufacturing Company, Itasca, Ill.

[21] Appl. No.: 14,837

[22] Filed: Feb. 8, 1993

[51] Int. Cl.[5] ..... B43L 15/00

[52] U.S. Cl. ..... 248/118; 400/715; 400/713; 248/118.1; 248/918

[58] Field of Search ..... 248/118, 118.1, 118.3, 248/118.5, 918, 345.1; 400/715, 714, 713; 361/222

[56] References Cited

U.S. PATENT DOCUMENTS

| | | | |
|---|---|---|---|
| D. 328,892 | 8/1992 | Miller . | |
| D. 330,018 | 10/1992 | Miller . | |
| 4,481,556 | 11/1984 | Berke et al. . | |
| 4,482,063 | 11/1984 | Berke et al. . | |
| 4,482,064 | 11/1984 | Berke et al. . | |
| 4,545,554 | 10/1985 | Latino et al. . | |
| 4,621,781 | 11/1986 | Springer . | |
| 4,688,862 | 8/1987 | Fowler et al. . | |
| 4,709,972 | 12/1987 | LaBudde et al. | 312/208.3 |
| 4,913,390 | 4/1990 | Berke . | |
| 4,973,176 | 11/1990 | Dietrich . | |
| 4,976,407 | 12/1990 | Schwartz et al. . | |
| 5,004,196 | 4/1991 | Gross . | |
| 5,040,757 | 8/1991 | Benaway . | |
| 5,050,826 | 9/1991 | Johnston . | |
| 5,056,743 | 10/1991 | Zwar et al. . | |
| 5,072,905 | 12/1991 | Hyatt . | |
| 5,088,668 | 2/1992 | Grimm . | |
| 5,125,606 | 6/1992 | Cassano et al. . | |
| 5,131,614 | 7/1992 | Garcia et al. . | |
| 5,147,090 | 9/1992 | Mandell et al. . | |
| 5,193,925 | 3/1993 | Foulke | 400/713 X |

OTHER PUBLICATIONS

Pp. 496–501 from a 1992 United Stationers catalog with pp. 496–500.
Pp. 79 and 559 from a 1992 Boise catalog.
Pp. 6, 7 and 73 from the Oct. 1992 Global catalog.
Pp. 170–172 from the Fall 1992 Reliable catalog with pp. 170 and 171.
Pp. 144 and 145 from the 1992/1993 Staples catalog.
Pp. 256–257, 259, 261–263 from the Nov., 1992 Quill catalog.
Pp. 7 and 64–65 from a 1992 Misco catalog.
P. 60 from a 1992 Curtis catalog.
P. 14 from a 1992 Lyben catalog.
An undated catalog from Precision Line Inc.
P. 98 from a 1992 DARTEK catalog.
An undated advertisement for wrist supports from the Protector.
An undated brochure for wrist supports from AliMed Inc.
An undated brochure for wrist supports from Wrist Air Inc.
An undated brochure from Ergodyne Corp. showing wrist supports.
An undated advertisement for a wrist support from Synergy+.
An undated brochure from Silicon Sports.
An undated advertisement for wrist supports from SIS Human Factor Technologies, Inc.
An undated advertisement for wrist supports from Fox Bay Industries.

*Primary Examiner*—Blair M. Johnson
*Attorney, Agent, or Firm*—Willian Brinks Hofer Gilson & Lione

[57] ABSTRACT

A cover and wrist rest for a keyboard, such as for computers, is provided so that in one position it can provide a closed compartment suitable for storing computer diskettes, pens, pencils, and the like and also provide support for a user's wrist and in another position it can cover the keys of the keyboard to prevent damage to the keys and unwanted material from entering the space between the keys.

17 Claims, 3 Drawing Sheets

KEYBOARD COVER AND WRIST REST

BACKGROUND OF THE INVENTION

The present invention relates to a cover and wrist rest for a keyboard, particularly for a computer keyboard.

Generally, the keys on a keyboard are elevated from the surface on which they are placed. One problem caused by the elevation of the keys or the keyboard is that the user's wrists may be placed in a position that may cause discomfort. To alleviate or soothe the potential discomfort, a rest for the user's wrists may be provided in front of the keyboard.

A wrist rest may provide an elevated structure that may be padded and may include a surface to support the keyboard. One problem with these wrist rests is that they waste space on the desk or the surface upon which they are placed. To minimize the amount of wasted space, it would be desirable to provide a compartment within the wrist rest in which materials could be stored.

Another problem with keyboards is that they can accumulate dust when they are left standing for a prolonged period of time. In addition, the keys and keyboard can be damaged by an impact to the keys and by spills of liquid material onto the keyboard. Consequently, it is desirable to provide a keyboard cover to protect the keys when they are not in use. One disadvantage with existing covers is that they are bulky and can not be easily stored when they are not in use. Accordingly, there is a need for a keyboard cover that can be easily stored out of the way of the user.

The present invention solves these problems by providing a keyboard cover that can be folded to a wrist rest position to provide a rest for a keyboard user's wrists. Moreover, the present invention provides a storage compartment useful for computer diskettes, storing pens, pencils, note pads, and the like within the wrist rest.

SUMMARY OF THE INVENTION

The present invention provides a multi-functional cover and wrist rest for a keyboard, particularly computer keyboards. The cover and wrist rest comprise an upper tray hinged to a lower tray. Preferably, the front of the upper tray is hinged to the front of the lower tray. More preferably, the front of the upper tray is removably hinged to the front of the lower tray. The lower tray has a front and a rear with the rear adjacent the front of the keyboard. The lower tray may also be provided with two opposite side walls extending substantially vertically upward. Preferably, the lower tray has a substantially vertical wall at the front and the rear with each of the front and rear wall at a substantially right angle to the side walls so that a lower compartment is provided suitable for storing computer disks, pens, pencils, note pads and the like. In a more preferred embodiment, a plurality of ridges may be provided on the top surface of the lower tray to define compartments useful for separating and containing computer diskettes, pens, pencils, and the like.

The upper tray has a front and a rear, with the rear adjacent the front of the keyboard and the front being hinged to the front of the lower tray such that in a keyboard cover position the upper tray and lower tray cover the keys on the keyboard and in a wrist rest position the upper tray is located above the lower tray so that the top surface of the upper tray provides a rest for a keyboard user's wrists.

The top surface of the upper tray is preferably downwardly curved at its front to provide a smooth continuous surface for the user's wrist when in the wrist rest position. The rear of the upper tray preferably has a downwardly extending rear wall. The upper tray may also be provided with downwardly extending walls including a front wall opposite a rear wall and side walls at a substantially right angle to the rear wall such that when in a wrist rest position the side walls most preferably enclose the side walls of the lower tray. In a preferred embodiment, the rear wall of the upper tray substantially abuts the rear wall of the lower tray when in a wrist rest position. In this way a closed compartment suitable for storing computer diskettes, pens, pencils, and the like is provided while at the same time providing a wrist rest for a keyboard.

In another embodiment of the invention, a base panel is also provided and has a front, a rear, two sides, an upper surface and an underside. Preferably, the base panel is rigid so that a keyboard can be supported, especially when the rear of the base panel is raised. The front of the base panel is hinged to the rear of the lower tray, preferably removably hinged. In this embodiment, a keyboard may be placed on the upper surface of the panel so that the rear of the lower tray is adjacent the keyboard. Of course, the keyboard may be placed at any suitable distance from the rear of the lower tray depending on the size of the user's hands and wrists and the user's desired comfort. The front of the lower tray is also hinged to the front of the upper tray as described above so that in one position the upper tray and the lower tray cover the keys on the keyboard and in another position the upper tray is located above the lower tray to provide a closed compartment and a rest for a keyboard user's wrists.

Although the cover and wrist rest of the present invention is particularly useful for computer keyboards, it is to be understood that the cover and wrist rest of the present invention can also be used with the keyboards for laptop, notebook, and sub-notebook computers as well as other types of keyboards (e.g., typewriter keyboards). For ease of description and without being limited, the present invention will be described by referring to a computer keyboard.

BRIEF DESCRIPTION OF THE DRAWINGS

With reference to FIGS. 1–8 it is to be understood that the figures are not necessarily drawn to scale and are not to be interpreted as being precisely to scale.

DETAILED DESCRIPTION OF THE INVENTION AND PREFERRED EMBODIMENTS

Figure 1:
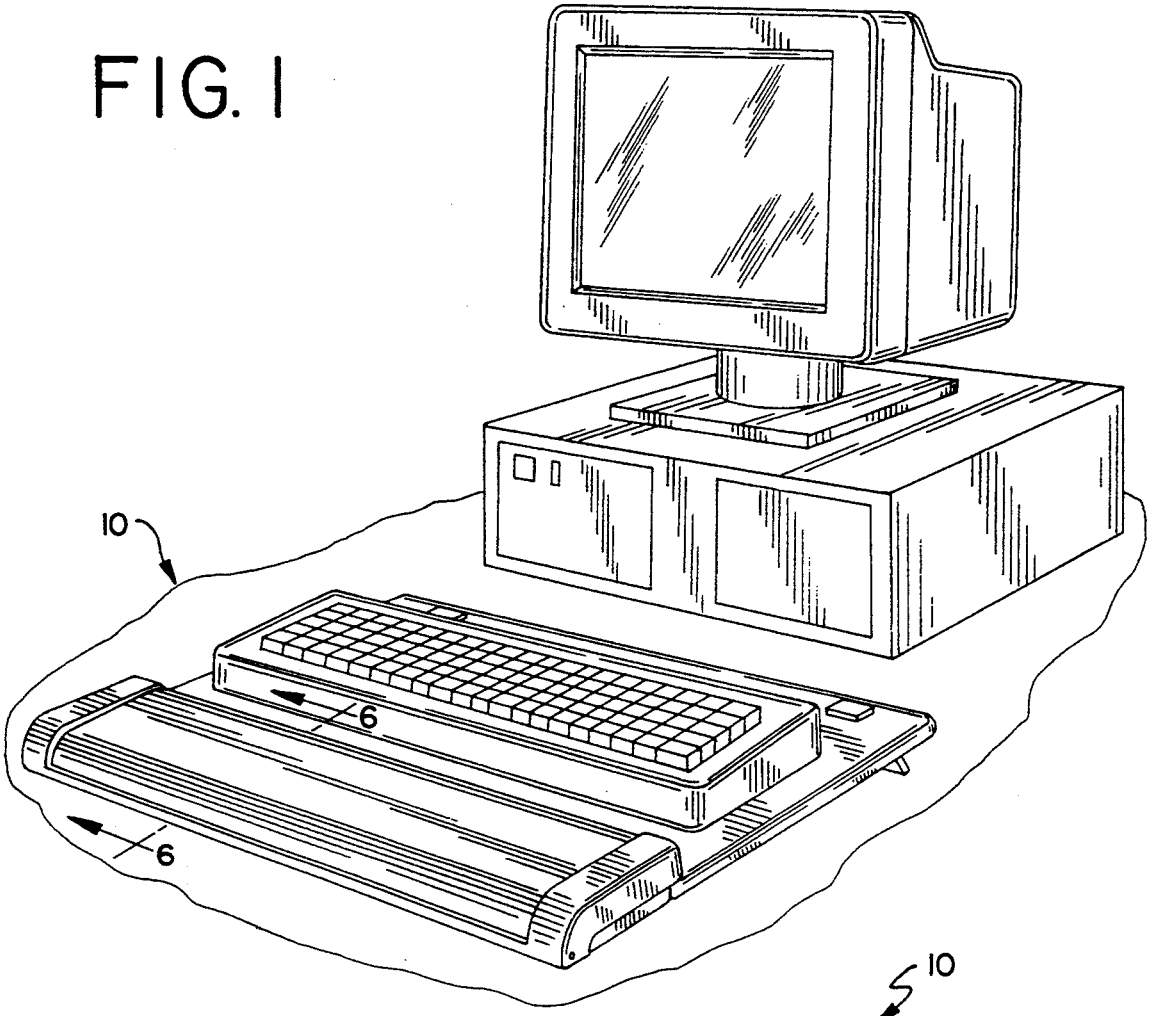
FIG. 1 is a front perspective view of the most preferred embodiment of the keyboard cover and wrist rest with a keyboard positioned on the base panel.

FIGS. 1–6 illustrate the preferred embodiment of the invention with FIG. 1 showing the cover and wrist rest in a wrist rest position with a keyboard for a computer. The cover and wrist rest of the preferred embodiment includes a base panel having a front and a rear and being suitable for supporting a keyboard; a lower tray with a front and a rear hinged to the front of the base panel; an upper tray with a top surface, a front hinged to the front of the lower tray and a rear. In this wrist rest position, the upper tray is located above the lower tray so that the top surface provides a rest for a keyboard user's wrists. More preferably, the base panel, lower tray, and upper tray are each separately integrally molded so that they can be easily assembled by the user.

The lower tray 12 more particularly includes a bottom 14 with four walls extending substantially vertically upward to form a lower half of a storage compartment. The walls include a front wall 16, a rear wall 18 spaced from and substantially parallel to the from wall 16, a first side wall 20 at a substantially fight angle to the front wall 16, and a second side wall 22 spaced from and substantially parallel to the first side wall 16. Although it is desired to provide the four walls as described above so that a closed compartment can be provided, it is not necessary to provide all four walls. When the cover and wrist rest is in a wrist rest position, the rear wall 18 is adjacent the keyboard. Of course, the keyboard may abut or may be spaced from the rear wall 18 as dictated by, among other things, the comfort of the user.

Figure 3:
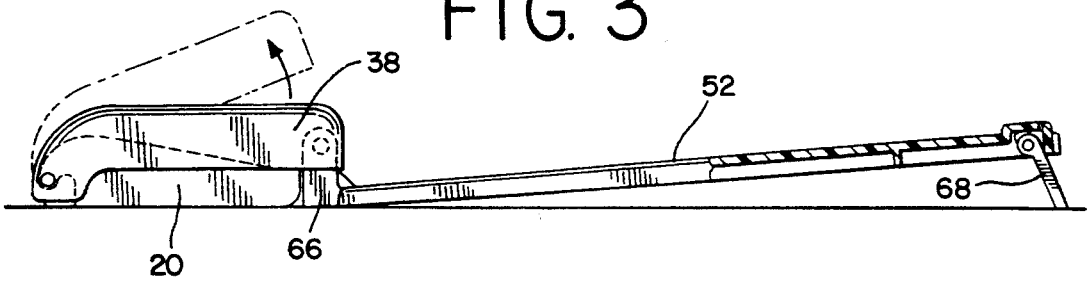
FIG. 3 is a side view of the keyboard cover and wrist rest of FIG. 1 shown with the height adjustment levers in the extended position and the upper tray in a closed position to provide a wrist rest. The dotted lines show the movement of the upper tray toward an open position.

As best seen in FIG. 3, the top surface of the bottom 14 may be provided with a plurality of ridges to define compartments useful for storing computer diskettes, pencils, pens, and the like. In the particular embodiment shown, compartments are provided for storing computer diskettes, particularly 3½ inch computer diskettes, and compartments are provided that are useful for storing pens, pencils, and the like.

Where the lower tray is to be used on a worksurface such as a wooden desk top or the like, it is desirable to provide non-skid feet on the underside of the lower tray 12. The non-skid feet may be manufactured from rubber or other material that will minimize unwanted movement of the lower tray about the work surface.

The upper tray 30 more particularly includes a top surface with four walls extending substantially vertically downward to form an upper half of a storage compartment when the trays are in a wrist rest position. The walls include a front wall 34, a rear wall 36 spaced from and substantially parallel to the front wall 34, a first side wall 38 at a substantially right angle to the front wall 34, and a second side wall 40 spaced from and substantially parallel to the first side wall 34. When the trays are in a wrist rest position, the rear wall 36 is adjacent the keyboard. As noted above, the keyboard may abut or be spaced from the rear wall 36. Preferably, when the trays 12 and 30 are in a wrist rest position as described above, and when the lower tray is provided with four walls, the side walls 38 and 40 of the upper tray enclose the side wall 20 and 22 of the lower tray and the rear wall 36 of the upper tray substantially abuts the rear wall 18 of the lower tray to provide a closed compartment.

Figure 6:
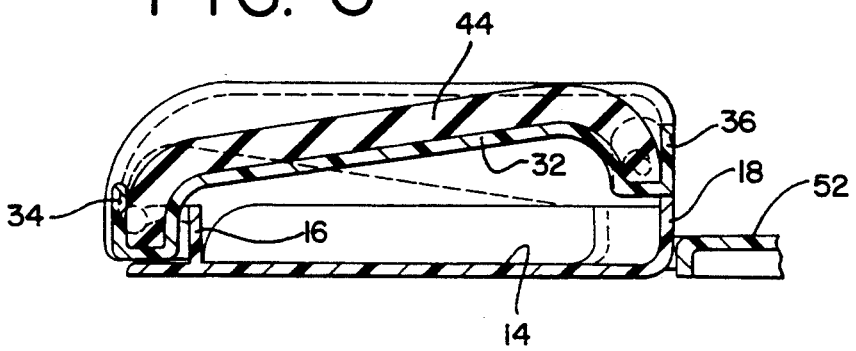
FIG. 6 is a cross sectional view of the upper tray of FIG. 1 along the line 6—6.

The top surface 32 of the upper tray 30 is preferably downwardly curved near the front to provide a smooth surface for the user's wrists. More preferably, the top surface 32 is contiguous with the front wall 34 and is curved downward to provide an uninterrupted surface for the comfort of the user. The top or upper surface 32 of the upper tray 30 may also be upwardly angled, as best seen in FIG. 6, to provide a support surface for the user's wrists. In this case, the vertical height of the top surface 32 near the front is lower than the vertical height of the top surface 32 near the rear.

To provide further comfort to the user's wrists, a pad 44 may be provided on at least a portion of the top surface 32. The pad 44 may be of any resilient material suitable for cushioning the wrists. For example, neoprene rubber, foams manufactured from rubber, urethane, and polyester, and the like may be used. Preferably, the pad is secured to the top surface 32 in any suitable manner by glue, adhesive, rivets, and the like, most preferably, by applying a double sided adhesive tape to one surface of the pad and then securing the pad onto the top surface 32. The pad may also be covered by any suitable fabric that will not chafe the user's wrists yet provide a feeling of softness and comfort.

Preferably, when the trays are in a wrist rest position, best seen in FIG. 1, the upper tray 30 is located above the lower tray 12 with the side walls 38 and 40 encompassing the side walls 20 and 22 and the rear wall 36 substantially abutting the rear wall 18. Alternatively, the upper tray 30 may, in the wrist rest position, fit within the lower tray 12 or may form one-half of a closed compartment with the lower tray forming the other haft. The front of the lower tray is hinged to the front of the upper tray 30. Of course, any suitable means for providing a hinge or pivot can be used. Preferably, the front of the lower tray 12 is removably hinged to the front of the upper tray 30 so that the trays can be separately molded from plastic and then easily assembled by the user.

Figure 5:
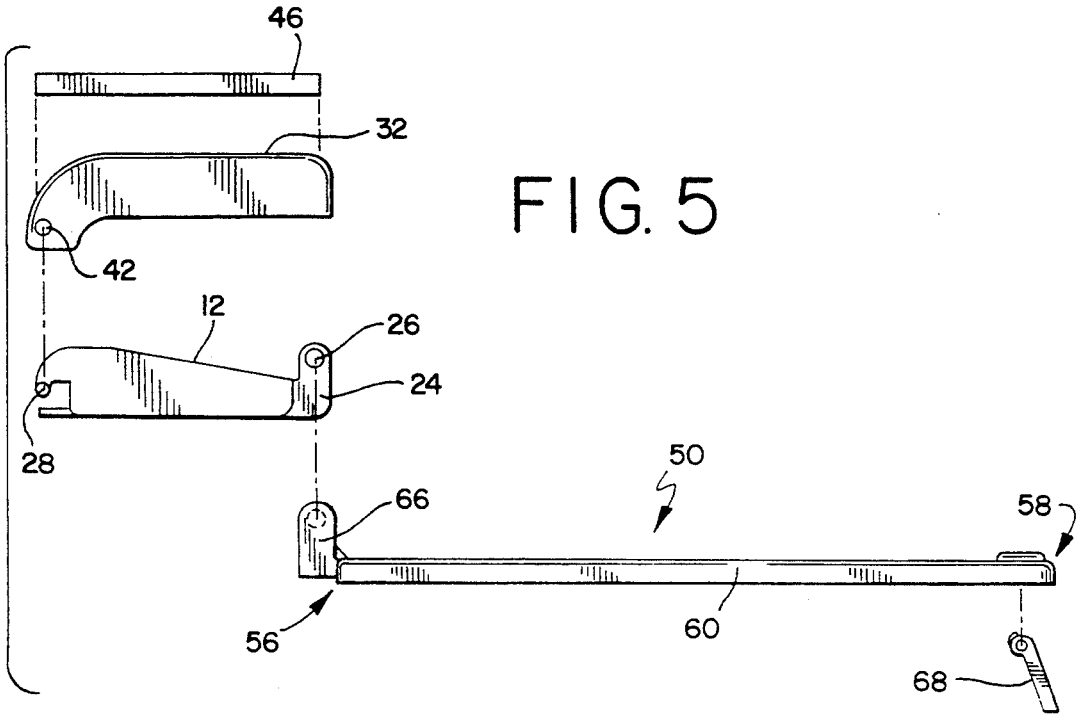
FIG. 5 is a side exploded view of the keyboard cover and wrist rest of FIG. 1.

In a more preferred embodiment, each of the side walls 20 and 22 of the lower tray is provided with an extending pin 28 near the front, best seen in FIG. 5, that removably engages a corresponding aperture 42 provided on each of the side walls 38 and 40 near the front of the upper tray to removably hinge the front of the lower tray 12 to the front of the upper tray 30. In other words, the extending pin 28 provided on side wall 20 removably engages the aperture 42 on side wall 38. In this way, the upper tray 30 can pivot to an open position, shown in FIG. 2, to expose the bottom 14 of the lower tray 12 so that the user can gain access to materials such as computer diskettes, pens, pencils, note pads and the like that can be placed on the bottom 14 of the lower tray 12.

In the most preferred embodiment, a base panel 50 is provided having a top surface 52 and being suitably rigid to support a keyboard. Preferably, the base panel 50 is integrally molded from plastic. The base panel 50 includes a front 56, a rear 58, and two sides 60 and 62. The front 56 of the base panel is hinged to the rear 18 of the lower tray. Of course, any suitable means for providing a hinge or pivot can be used. Preferably, the front 56 of the base panel is removably hinged to the rear 18 of the lower tray so that the trays 12 and 30 and the base panel 50 can be separately molded from plastic and then easily assembled by the user. Preferably, the base panel 50 has at least one, more preferably two, upstanding members 66 at .its front 56, preferably adjacent the sides 60 and 62. The upstanding members 66 preferably have an extending pin to removably engage an aperture 26 provided in corresponding upstanding members 24 provided on the lower tray 12. In this way, each of the lower tray 12, the upper tray 30, and the base panel 50 can be separately integrally molded from plastic and easily assembled, as seen in FIG. 5.

The base panel 50 is preferably provided with at least one height adjustment lever 68 at the rear 58 of the underside of the base panel. In accordance with the most preferred embodiment, two spaced apart height adjustment levers 68 are provided at the rear underside of the base panel 50. The lever 68 can be moved to an extended downstanding position to vertically adjust the height of the rear 58 of the base panel so that the panel 50 slopes downwardly from the rear 58 to the front 56. In this way, the keyboard may be sloped downwardly to provide a more comfortable angle for the user. More preferably, the lever 68 is cammed so that the lever may be moved to one of two positions with a first position underneath the base panel so that the base panel is in a substantially horizontal position and a second position extending downwardly from the base panel to raise the rear of the panel 50, as described above.

The underside of the base panel may also be provided with rubber feet or the like to minimize unwanted movement of the base panel on the work surface.

Use of the cover and wrist rest of the most preferred embodiment will now be described with particular reference to FIGS. 1–4. FIG. 1 shows the upper 30 and lower 12 trays in a wrist rest position with a keyboard for a computer supported on the top surface 52 of the base panel. Preferably, the length of the lower tray 12 (i.e., the distance from the first side wall 20 to the second side wall 22) and the upper tray 30 is substantially the same as the length of the keyboard to provide a wrist support for the user.

It is to be understood, however, that the lengths of the lower tray 12 and the upper tray 30 may vary depending on the length of the keyboard. Since several different types of keyboards exist, many having a different length and width, it is understood that the length and width of the trays can be adjusted to provide a suitable cover and wrist rest. The length of the upper and lower trays can be varied to accommodate the length of the keyboard. The length of the lower tray can be greater than the length of the keyboard. Alternatively and more preferred, the length of the lower tray is somewhat less than the length of the keyboard. The width (i.e., the distance from the front to the rear) of the upper 30 and lower 12 trays can be varied so that when the trays are in a cover position all the keys of the keyboard can be covered. The height of the walls can be of any suitable height such that when the trays are in a wrist rest position they provide a useful wrist rest for the user of a keyboard.

Figure 2:
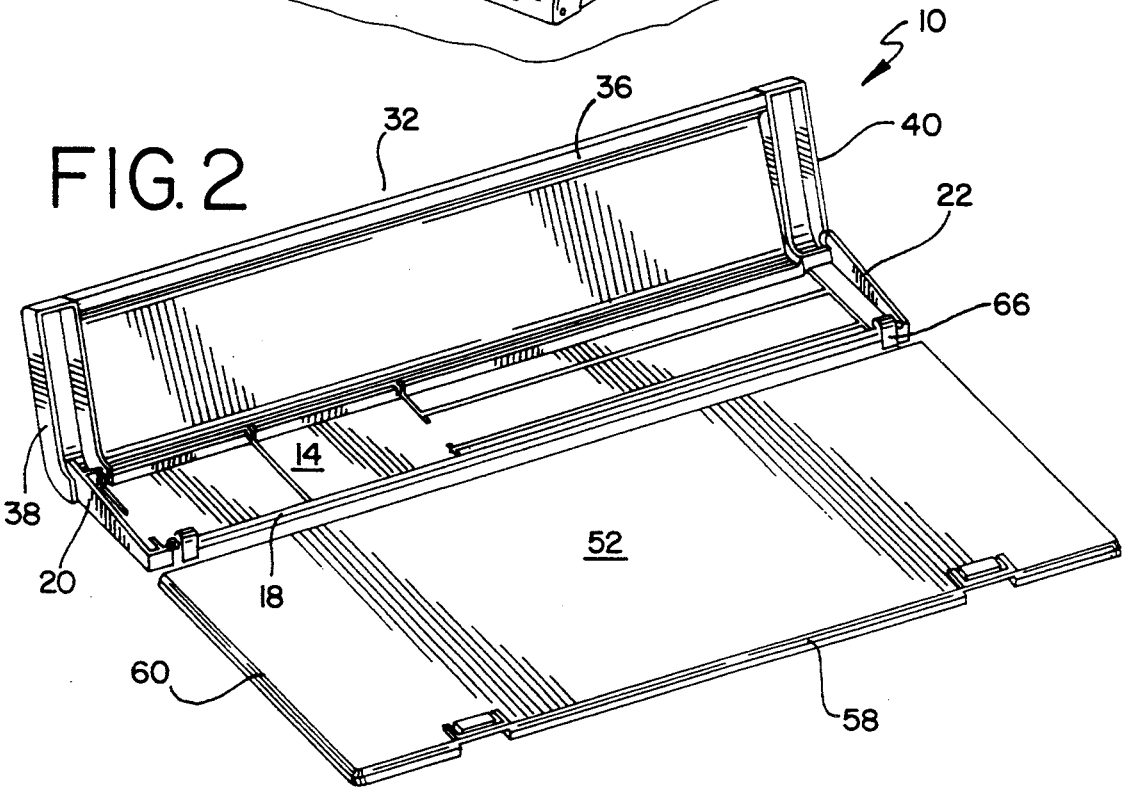
FIG. 2 is a perspective view of the keyboard cover and wrist rest of FIG. 1 shown with height adjustment levers provided on the base panel and in the extended position and with the upper tray shown in a partially open position to reveal the inside of the lower tray, particularly the ridges useful for separating and containing articles.

FIG. 2 shows the upper tray 30 in a partially open position. In this position, the bottom 14 of the lower tray is exposed and items such as pens, pencils, note pads, and computer diskettes are accessible. Of course, it is understood that the amount and type of material that can be stored in the lower tray may be dictated by the length and width of the lower tray 12 in conjunction with the height of the walls of the lower tray and the height of the walls of upper tray 30. In one embodiment, the width of the lower tray 12 is such that 3½ inch computer diskettes can be stored in the lower tray.

Figure 4:
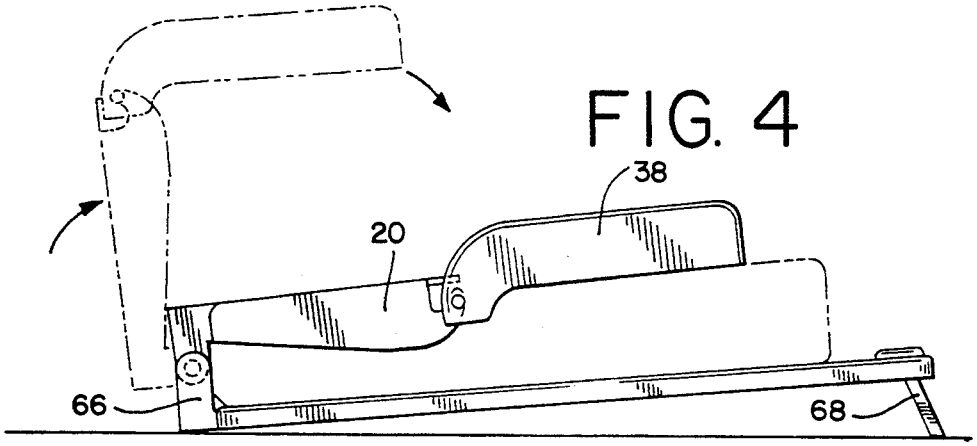
FIG. 4 is a side view of the keyboard cover and wrist rest of FIG. 3 showing the trays in position to cover the keys on the keyboard with the dotted line showing the movement of the upper and lower tray from a wrist rest position to a keyboard cover position.

FIG. 3 shows the trays 12 and 30 in a wrist rest position with the dotted lines showing the pivoting of the upper tray to either the open position of FIG. 2 or the cover position of FIG. 4. When it is desired to use the trays in a cover position, such as when the keyboard is not in use, the upper tray 30 can pivot about the lower tray 12 while the lower tray can pivot about the base panel 50, as best seen in FIG. 4. In this cover position, the rear wall 36 of the upper tray 30 rests on the upper portion of the keyboard so that the keys are encompassed and protected by the upper and lower trays. Of course, the height of the rear wall 36 is sufficient to encompass the uppermost keys on the keyboard. In the embodiment shown in FIG. 4, the length of the lower tray 12 and upper tray 30 is greater than the length of the keyboard. In this embodiment, the side walls 20 and 22 of the lower tray extend downwardly over the side walls of the keyboard.

Figure 7:
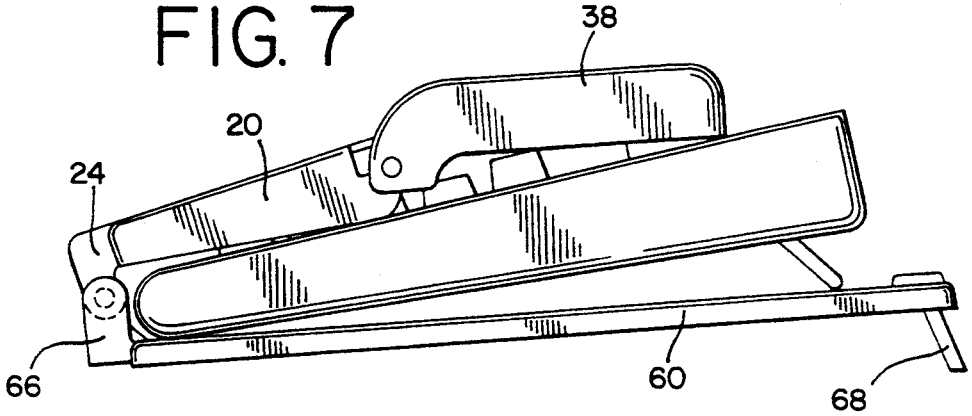
FIG. 7 is a side view of another embodiment of the keyboard and wrist rest in position to cover the keys on the keyboard wherein the upper and lower trays have a length less than the length of the keyboard.

In another embodiment, shown in FIG. 7, where the length of the lower tray 12 and upper tray 30 is less than the length of the keyboard, the rear wall 36 of the upper tray 30 rests on the upper portion of the keyboard. In this embodiment, all or a portion of the side walls 20 and 22 of the lower tray also rest on the keyboard, as best seen in FIG. 7, to encompass the keys.

Figure 8:
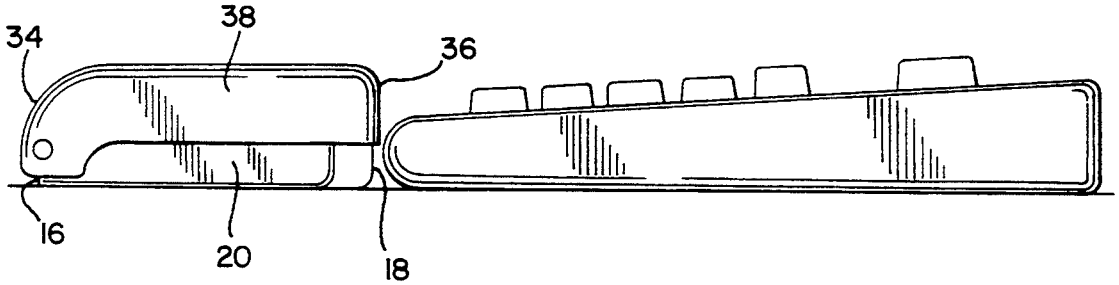
FIG. 8 shows another embodiment of the keyboard and wrist rest of the present invention.

FIG. 8 shows another embodiment of the present invention, with like numbers referring to like parts, wherein an upper tray 30 and a lower tray 12 are provided without the base panel 50. In this embodiment, when the trays are in a wrist rest position, the rear 18 of the lower tray and the rear 36 of the upper tray are adjacent the front of the keyboard. Of course, as noted above, the keyboard may abut or may be spaced from the rear of the lower tray 18 and the rear of the upper tray 36 as dictated by, among other things, the comport of the user. As described above, the front 16 of the lower tray is hinged to the front 34 of the upper tray. The trays can be pivoted about the hinge and lifted over the keys of the keyboard to rest on the keyboard and provide a cover for the keys and the keyboard.

It should be understood that a wide range of changes and modifications can be made to the embodiments described above. It is therefore intended that the foregoing description illustrates rather than limits this invention, and that it is the following claims, including all equivalents, which define this invention.

I claim:

1. A cover and wrist rest for a keyboard comprising:

a. a lower tray with a bottom, a front and a rear with the rear adjacent the keyboard; and, b. an upper tray with a top surface, a front, and a rear, the front of the upper tray being hinged to the front of the lower tray;

c. means hingedly mounting the lower tray's rear whereby the lower and upper trays are pivotable between a first keyboard cover position wherein the upper tray and lower tray are adapted to cover the keys on the keyboard and a second wrist rest position wherein the upper tray is adapted to be located above the lower tray so that the top surface of the upper tray provides a rest for a keyboard user's wrists and such that the top surface of the upper tray is above and spaced from the bottom of the lower tray to define a compartment.

2. The cover and wrist rest of claim 1 wherein the lower tray and the upper tray are each integrally molded from plastic.

3. The cover and wrist rest of claim 1 wherein the top surface of the upper tray is upwardly angled from the front to the rear.

4. The cover and wrist rest of claim 1 further having a pad of resilient material provided on at least a portion of the top surface of the upper tray.

5. The cover and wrist rest of claim 1 wherein the upper tray further has a first side opposite a second side, each side having an aperture provided near the front of the upper tray; and wherein the lower tray further has a first side and a second side with an extending pin provided on each side near the front that removably engages the apertures to removably hinge the front of the upper tray to the front of the lower tray.

6. The cover and wrist rest of claim 1 wherein the upper tray encompasses the lower tray when the trays are in a wrist rest position.

7. The cover and wrist rest of claim 1 wherein the top surface of the lower tray further has a plurality of ridges.

8. A cover and wrist rest for a keyboard comprising:

a. a base panel having a front, a rear, two sides, an upper surface suitable for supporting the keyboard and an underside;

b. a lower tray with a bottom, a front, a rear opposite the front, and two opposing sides, the tray rear hinged with the panel front; and, c. an upper tray with a top, a front, a rear opposite the front, and two opposing sides, the upper tray front hinged to the lower tray front such that in one position the upper tray and the lower tray are adapted to cover the keys on the keyboard supported on the base panel and in another position the upper tray is adapted to be located above the lower tray to define a compartment and a rest for a keyboard user's wrists.

9. The cover and wrist rest of claim 8 wherein the base panel, the lower tray, and the upper tray are each integrally molded from plastic.

10. The cover and wrist rest of claim 8 wherein a pad is attached to at least a portion top of the upper tray.

11. The cover and wrist rest of claim 8 wherein the top surface of the upper tray top is upwardly angled from the front to the rear.

12. The cover and wrist rest of claim 8 wherein the top surface of the lower tray further has a plurality of ridges.

13. A cover and wrist rest for a keyboard comprising:

a. a rigid base having a from, a rear, two sides, an upper surface suitable for supporting the keyboard and an underside, the panel front having an upstanding member with an extending pin adjacent each side;

b. a lower tray with a bottom, a front, a rear opposite the front, and two opposing sides, each side having an extending pin near the front, the tray rear having an upstanding member adjacent each tray side, each upstanding member having an aperture to removably receive the corresponding pin on the base to removably hinge the lower tray rear to the base front; and, c. an upper tray with a top, a front, a rear opposite the front, and two opposing sides each having an aperture near the front to removably receive the corresponding extending pin in the lower tray to removably hinge the upper tray front to the lower tray front such that in one position the tray and the lower tray are adapted to cover the keys on the keyboard supported on the rigid base and in another position the upper tray is adapted to be located above the lower tray to provide a rest for a keyboard user's wrists and a closed compartment.

14. The cover and wrist rest of claim 13 further having a pad of resilient material provided on at least a portion of the top surface of the upper tray.

15. The cover and wrist rest of claim 13 wherein the top of the upper tray is upwardly angled from the front to the rear.

16. The cover and wrist rest of claim 13 wherein the top surface of the lower tray further has a plurality of ridges.

17. A cover and wrist rest for a keyboard comprising:

a. a base panel having a front, a rear, two sides, an upper surface suitable for supporting the keyboard and an underside;

b. a lower tray with a bottom having a top surface with a plurality of ridges, a front, a rear opposite the front, and two opposing sides, the tray rear hinged with the panel front; and, c. an upper tray with a top, a front, a rear opposite the front, and two opposing sides, the upper tray front hinged to the lower tray front such that in one position the upper tray and the lower tray are adapted to cover the keys on the keyboard supported on the base panel and in another position the upper tray is adapted to be located above the lower tray to provide a closed compartment and a rest for a keyboard user's wrists.

* * * * *